United States Patent [19]

Nobel et al.

[11] 3,963,455

[45] June 15, 1976

[54] ELECTRODEPOSITED GOLD PLATING

[75] Inventors: Fred I. Nobel; Barnet D. Ostrow, both of Roslyn, N.Y.

[73] Assignee: Lea-Ronal, Inc., Freeport, N.Y.

[22] Filed: Feb. 26, 1975

[21] Appl. No.: 553,145

Related U.S. Application Data

[63] Continuation of Ser. No. 323,287, Jan. 12, 1973, abandoned.

[52] U.S. Cl. ..... 29/198; 29/199

[51] Int. Cl.[2] ..... B32B 15/00

[58] Field of Search ..... 29/198, 199; 204/466

[56] References Cited

UNITED STATES PATENTS

| | | | |
|---|---|---|---|
| 2,149,657 | 3/1939 | Armstrong | 29/198 |
| 2,429,222 | 10/1947 | Ehrhardt | 29/199 |
| 2,816,066 | 12/1937 | Russell | 29/198 |
| 3,000,085 | 9/1961 | Greer | 29/199 |
| 3,364,064 | 1/1968 | Nijburg | 29/199 |

*Primary Examiner*—Arthur J. Steiner

*Attorney, Agent, or Firm*—Pennie & Edmonds

[57] ABSTRACT

The method of preventing or inhibiting diffusion of a base metal into an electrodeposited gold layer on said base metal which comprises electrodepositing a barrier layer on the base metal comprising a tungsten-cobalt alloy or a tungsten-nickel alloy and subsequently electrodepositing gold on the alloy barrier layer. The invention also includes the use of chelating agents in tungsten-cobalt and tungsten-nickel plating baths.

2 Claims, No Drawings

ELECTRODEPOSITED GOLD PLATING

This is a continuation of application Ser. No. 323,287, filed Jan. 12, 1973, now abandoned.

BACKGROUND OF THE INVENTION

I. Field of the Invention

This invention generally relates to the electrodeposition of gold or gold alloys onto base metals.

II. Description of the Prior Art

The electrodeposition of gold on base metals or base metal alloys can readily be accomplished by known methods and are generally satisfactory for most purposes. When these gold plated base metals, however, are subjected to high temperatures for short periods of time (e.g. 450° to 500°C for 5 to 10 minutes) or at more moderate temperatures for longer periods of time (e.g. 300°C for 70 hours), the base metal diffuses into the gold plating which adversely affects the desired function of the gold plating such as electrical conductivity, often to the point of complete failure of the gold plated component for its intended function. This diffusion can generally be visually observed by a discoloration of the gold plating.

One manner of overcoming this diffusion problem, which has been practiced in the art, is to electrodeposit extremely thick layers of gold, as high as 80 microinches or higher so that the diffusion of the base metal into the gold layer does not significantly affect the outer surface or the functional portion of the gold deposit so that the gold plated component can function for its intended purpose at high temperatures and time. The use of such extremely thick deposits of gold is of course very expensive and in many cases is not practical or useful in commercial operations.

Various barrier coatings have been used in the past in an attempt to prevent or inhibit this diffusion of the base metal into the gold platings to reduce the thickness of the gold deposits and thereby reduce the cost. For example, chromium has been suggested as a barrier coat to prevent diffusion of the base metal into the gold layer, but this has never been commercially practical particularly in view of the significant difficulties encountered in attempting to plate gold over chromium metal with present technology and the difficulties encountered in plating chromium in barrels to obtain sufficient chromium coverage over the surface of the large variety of parts encountered in electronic component plating.

Nickel barrier coats have also been used to prevent diffusion of base metal into the gold. Although nickel barrier layers have been partially successful, fairly thick deposits of gold are still required. Gold plated components having a nickel barrier thereon can generally stand about 500°C. for about 5 to 10 minutes provided that the thickness of the gold deposits is on the order of 60 to 70 microinches. This is of course an improvement over the deposition of gold directly on the base metal which requires about 80 microinches under the same operating conditions to prevent diffusion of the base metal and possible failure. Nickel barrier coatings also introduce into the gold plated components, magnetism which may impair the usefulness of the gold plated components particularly where the magnetic effect of the nickel coating would interfere with the proposed electronic function of the component.

SUMMARY OF THE INVENTION

This invention relates to the use of a tungsten-cobalt alloy or a tungsten-nickel alloy as a barrier coat on base metals over which a layer of gold is electrolytically deposited. The use of these alloys as a barrier coat on base metals over which gold is electrically deposited prevents or significantly inhibits the diffusion of the base metal into the gold deposit at high temperatures for short periods of time and at moderate temperatures over prolonged periods of time with thin gold layers in the order of 40 microinches. For example with a barrier coating of about 1 micron of a tungsten-cobalt alloy as disclosed herein on a base metal such as nickel-iron alloy (Kovar) and an electrodeposited gold layer of approximately 40 to 50 microinches thereover the plated component can withstand heat of approximately 500°C. for 10 minutes with no discoloration of this thin gold layer and little diffusion of the base metal into the gold, if any. Whereas without the barrier layer 80–100 microinches of gold would be required to pass the test.

The refractory metal alloy barrier coating according to this invention are tungsten-cobalt alloys and tungsten-nickel alloys. Generally, the higher the percentage of tungsten in the alloy, the lesser the diffusion of the base metal into the gold deposit. Pure tungsten has not been successfully electrodeposited by present technology from an aqueous solution so the amount of cobalt contained in the tungsten-cobalt alloy should at least be sufficient to permit an adequate co-electrodeposition of the tungsten-cobalt alloy from an aqueous solution. Cobalt in excess of 50 percent can of course be used, but as the amount of the cobalt is increased, the tendency for the base metal to fuse into the gold layer also increases. Present work has so far indicated that a cobalt-tungsten alloy containing 40 to 50 percent tungsten is most advantageous. The same criteria apply to the tungsten-nickel alloys.

The base metal upon which the tungsten-cobalt or tungsten-nickel alloys are plated and which are subsequently gold plated can be any of the base metals generally used in the industry for gold plating. Some examples of base metals include iron or iron alloys such as iron-cobalt and iron-nickel alloys, copper or copper alloys such as beryllium-copper, phosphor-bronze, the various brasses, copper-aluminum alloys and so forth. By way of illustration specific tungsten-cobalt baths are set forth below in Examples I and II:

EXAMPLE I

A tungsten-cobalt alloy was electrolytically deposited on an iron-nickel-cobalt alloy (Kovar) base metal at a thickness of about 1 micron using platinum anodes and the following bath

| | |
|---|---|
| $CoSO_4 \cdot 7H_2O$ | 58.5 g/l |
| $Na_2WO_4 \cdot 2H_2O$ | 68.0 g/l |
| Citric acid | 65 g/l |
| $NH_4OH$ | in sufficient amount to adjust the pH to about 7. |

The plating bath was operated at about 150° to 160°F. at a current density of 10 ASF under mild agitation for five minutes.

EXAMPLE II 20 gms. per liter of amino trimethyl phosphonic acid chelating agent were added to the bath of Example I.

The tungsten-cobalt alloy was plated on the same base metal as in Example I in a Hull cell for 5 minutes at a temperature of 150°to 160°F. at 1 amp.

Although any known baths for depositing tungsten-cobalt alloys or tungsten-nickel alloys can be used according to this invention, the addition of chelating agents to the baths, such as that set forth above in Example II have been found to be very advantageous, particularly for barrel plating small parts. The addition of chelating agents results in a significant extension of the current density range which can be used to apply the alloy barrier coats in the low current density range. The addition of the chelating agents also improves the covering power of the alloy being plated.

For example, when a Hull cell panel is prepared with the bath of Example I under the same conditions as set forth in Example II, the panel exhibits a poor coating (or even no coating at all in the low current density range). The low current density range shows a skip, white, nonlustrous plating. The bath also results in poor low current coverage on parts plated in a barrel. In contrast the Hull cell panel of Example II exhibited a bright, lustrous deposit to a very low current density. The bath of Example II also shows good low current coverage on the parts plated in a barrel.

In addition, the chelating agents added to the baths according to this invention also increases the stability of the plating bath. For example, in a bath such as set forth in Example I cobalt and/or tungsten will precipitate on standing or after a period of operation as insoluble metallic compounds. This may distort the ratio of metallic components of the alloy in the deposit. On the addition of a chelating agent such as the amino trimethyl phosphonic acid of Example II, this precipitation is greatly retarded or eliminated altogether. Thus the addition of chelating agents are most advantageous and desirable in all forms of plating but particularly advantageous in barrel plating.

Various chelating agents can be used in the tungsten-cobalt or tungsten-nickel alloy baths according to this invention as will be appreciated by those skilled in the art. These chelating agents are well known in the art. The most advantageous chelating agents are the organo-phosphorous chelating agents as disclosed in U.S. Pat. No. 3,672,969 issued to Nobel and Ostrow on June 27, 1972 and assigned to Lea-Ronal, Inc. This patent is incorporated herein by reference as part of this disclosure with respect to the chelating agents that can most advantgeously be used in coating of the tungsten-cobalt and tungsten-nickel alloys. Carboxylic acid chelating agents such as ethylene diamine tetracetic acid (EDTA) which are also well known in the art can also be advantageously employed according to this invention.

The amounts of the chelating agent used in the alloy baths can be substantially the same as that disclosed in U.S. Pat. No. 3,672,969, but should be present in sufficient amount to increase the stability of the baths or increase the current density range for improved barrel plating.

The tungsten-cobalt barrier plated base metals of Example I and II can then be coated with a gold deposit by electrodepositing in a conventional manner using for example the following gold plating bath:

| | |
|---|---|
| Potassium gold cyanide | 12 g/l |
| Amino-tri(methylphosphonic acid) | 75 g/l |
| Citric Acid | 50 g/l |
| Water | 1.0 l |

The pH of the solution is adjusted to about 6 by the addition of potassium hydroxide. The tungsten-cobalt plated base metal as prepared above is then gold plated in a conventional manner in this bath at a temperature of about 140°F and at a current density of 1 to 2 amperes per square foot, to deposit about 40 microinches of gold thereon. The gold deposit is lustrous and can withstand temperatures in the range of 450°C in air for 5 to 10 minutes, at about 500°C. for 5 minutes or at about 300°C for about 70 hours, there is no noticeable diffusion of the base metal or alloy barrier coating into the gold deposit.

Gold alloys can also be plated on the barrier coated base metals as is well known in the art, for example, by adding about 0.1 or 0.2 g/l of cobalt as metal in the sulfate to form the bath set forth above.

The thickness of the tungsten-cobalt or the tungsten-nickel barrier coating is not particularly critical, but should be of sufficient thickness to prevent the diffusion of the base metal into the ultimate gold coating at the temperature and times at which the component is to be operated. A thickness of about 1 micron has so far been found to be satisfactory.

Any gold bath capable of electrodepositing an acceptable gold layer can be used according to this invention, however, the applicants prefer to use the gold baths of U.S. Pat. No. 3,672,969 dated June 27, 1972 as illustrated by the above examples.

We claim:

1. A base metal or base-metal alloy having a tungsten alloyed barrier coating electrodeposited thereon and an electrodeposited gold or gold alloy plating on said barrier coating, wherein the metal alloyed with tungsten is cobalt or nickel and is alloyed therewith in an amount that will affect the electrodeposition of the tungsten in alloyed form on the base metal and containing a sufficient amount of tungsten to significantly inhibit diffusion of the base metal or base-metal alloy into the gold layer electrodeposited thereon at a thickenss of less than about 50 microinches.

2. The product of claim 1 in which the tungsten alloyed barrier coating contains at least about 40 percent tungsten.

* * * * *

UNITED STATES PATENT AND TRADEMARK OFFICE

CERTIFICATE OF CORRECTION

PATENT NO. : 3,963,455

DATED : June 15, 1976

INVENTOR(S) : Fred I. Nobel et al.

It is certified that error appears in the above-identified patent and that said Letters Patent are hereby corrected as shown below:

Column 4, line 48 "affect" should be --effect--

Column 4, line 52 "layer electrodeposited" should be --layer which is electrodeposited--

Signed and Sealed this

Seventh Day of September 1976

[SEAL]

*Attest:*

RUTH C. MASON
*Attesting Officer*

C. MARSHALL DANN
*Commissioner of Patents and Trademarks*